US010233714B2

(12) United States Patent
Cheah et al.

(10) Patent No.: US 10,233,714 B2
(45) Date of Patent: Mar. 19, 2019

(54) ROTATING HANGER AND RUNNING TOOL

(71) Applicant: Cameron International Corporation, Houston, TX (US)

(72) Inventors: Shuang Yong Cheah, Singapore (SG); Choon Keat Lai, Singapore (SG); Haw Keat Lim, Singapore (SG); Brandon B. Shirley, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 370 days.

(21) Appl. No.: 14/965,669

(22) Filed: Dec. 10, 2015

(65) Prior Publication Data

US 2017/0167218 A1 Jun. 15, 2017

(51) Int. Cl.

| | |
|---|---|
| ***E21B 33/043*** | (2006.01) |
| ***E21B 33/04*** | (2006.01) |
| ***E21B 23/02*** | (2006.01) |

(52) U.S. Cl.

CPC ..... *E21B 33/0415* (2013.01); *E21B 23/02* (2013.01); *E21B 33/043* (2013.01)

(58) Field of Classification Search

CPC ..... E21B 33/04; E21B 33/0415

See application file for complete search history.

(56) References Cited

U.S. PATENT DOCUMENTS

| | | | | |
|---|---|---|---|---|
| 3,420,308 | A | 1/1969 | Putch | |
| 4,067,388 | A | 1/1978 | Mouret et al. | |
| 5,551,512 | A * | 9/1996 | Smith | E21B 17/06 166/212 |
| 6,823,938 | B1 | 11/2004 | Milberger | |
| 8,528,650 | B1 | 9/2013 | Smith et al. | |
| 2007/0062707 | A1 * | 3/2007 | Leising | E21B 17/04 166/380 |
| 2011/0290476 | A1 * | 12/2011 | Steele | F16L 15/003 166/242.6 |
| 2012/0305269 | A1 * | 12/2012 | Bories | E21B 33/0415 166/382 |
| 2014/0231144 | A1 | 8/2014 | Sonar et al. | |
| 2014/0246209 | A1 * | 9/2014 | Themig | E21B 43/14 166/374 |
| 2014/0311753 | A1 | 10/2014 | Hanson et al. | |
| 2015/0041151 | A1 | 2/2015 | Cocker, III et al. | |
| 2015/0152701 | A1 * | 6/2015 | Levert, Jr. | E21B 33/04 166/380 |
| 2015/0247387 | A1 | 9/2015 | Massey et al. | |
| 2015/0260002 | A1 | 9/2015 | Nguyen et al. | |
| 2015/0330156 | A1 | 11/2015 | Barannikow et al. | |
| 2015/0345242 | A1 * | 12/2015 | Fernandes | E21B 23/01 166/208 |

FOREIGN PATENT DOCUMENTS

| | | | |
|---|---|---|---|
| WO | 2015105487 | A1 | 7/2015 |

* cited by examiner

*Primary Examiner* — Frederick L Lagman
(74) *Attorney, Agent, or Firm* — Eubanks PLLC

(57) ABSTRACT

A wellhead hanger assembly is provided. In one embodiment, a system includes a wellhead hanger, a running tool coupled to the wellhead hanger, and a torque sleeve positioned to transmit torque from the running tool to the wellhead hanger. The running tool can be in castellated engagement with the torque sleeve via a first set of castellations and mating slots, and the wellhead hanger can be in castellated engagement with the torque sleeve via a second set of castellations and mating slots. Additional systems, devices, and methods are also disclosed.

21 Claims, 18 Drawing Sheets

ROTATING HANGER AND RUNNING TOOL

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to wellhead hangers for suspending tubular strings in wells. In some embodiments, the wellhead hanger includes slots that facilitate rotation of the wellhead hanger via a running tool. More specifically, castellation legs of a torque sleeve on the running tool can engage the slots of the wellhead hanger to drive rotation of the wellhead hanger with the running tool via the torque sleeve. The torque sleeve can also have slots to receive castellations of the running tool. In one such embodiment, the running tool castellations engage the torque sleeve slots to cause rotation of the running tool to drive rotation of the torque sleeve, while the castellation legs of the torque sleeve engage the slots of the wellhead hanger to cause the wellhead hanger to rotate with the running tool. The castellation legs of the torque sleeve can be constructed to transmit torque to the wellhead hanger when rotated in one direction and to facilitate disengagement of the torque sleeve from the wellhead hanger when rotated in an opposite direction. In some embodiments, the torque sleeve includes a mechanism for indicating whether the wellhead hanger has landed on a shoulder of a wellhead. In one instance, the torque sleeve includes a shoulder that engages a stop shoulder in a wellhead when lowered with a running tool and wellhead hanger into the wellhead, and engagement of the torque sleeve shoulder with the mating shoulder of the wellhead causes the torque sleeve to disengage the wellhead hanger when the wellhead hanger is further lowered onto a different shoulder of the wellhead.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
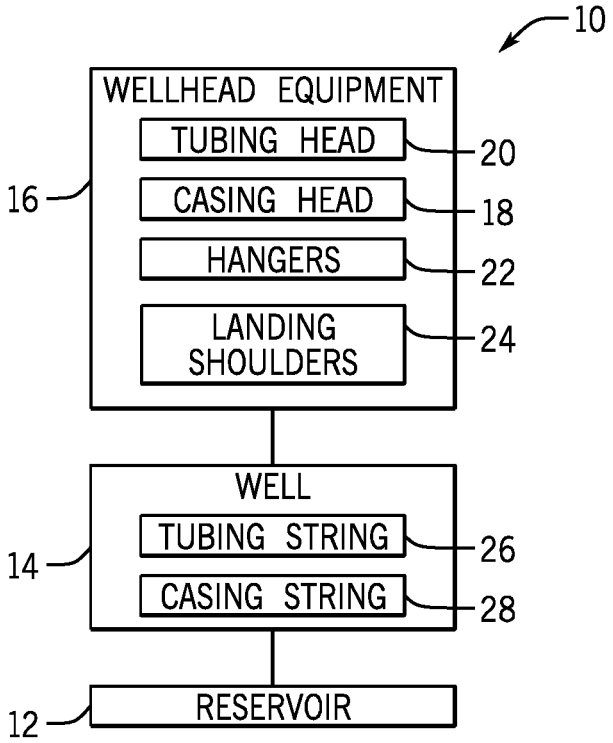
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating a casing string during cementing can increase uniformity of the cement about the casing string and reduce the size or frequency of undesirable cavities or fissures in the cement. Further, rotating tubular strings can also facilitate running of the strings into the well through the wellhead. Any suitable devices or machines may be used to rotate the wellhead hangers (and their attached tubular strings) and to run the strings into wells. For example, a top drive can be used to run a casing string into a well and to rotate the casing string. In some instances, the tubular strings are rotated via wellhead hangers attached to the strings.

Figure 2:
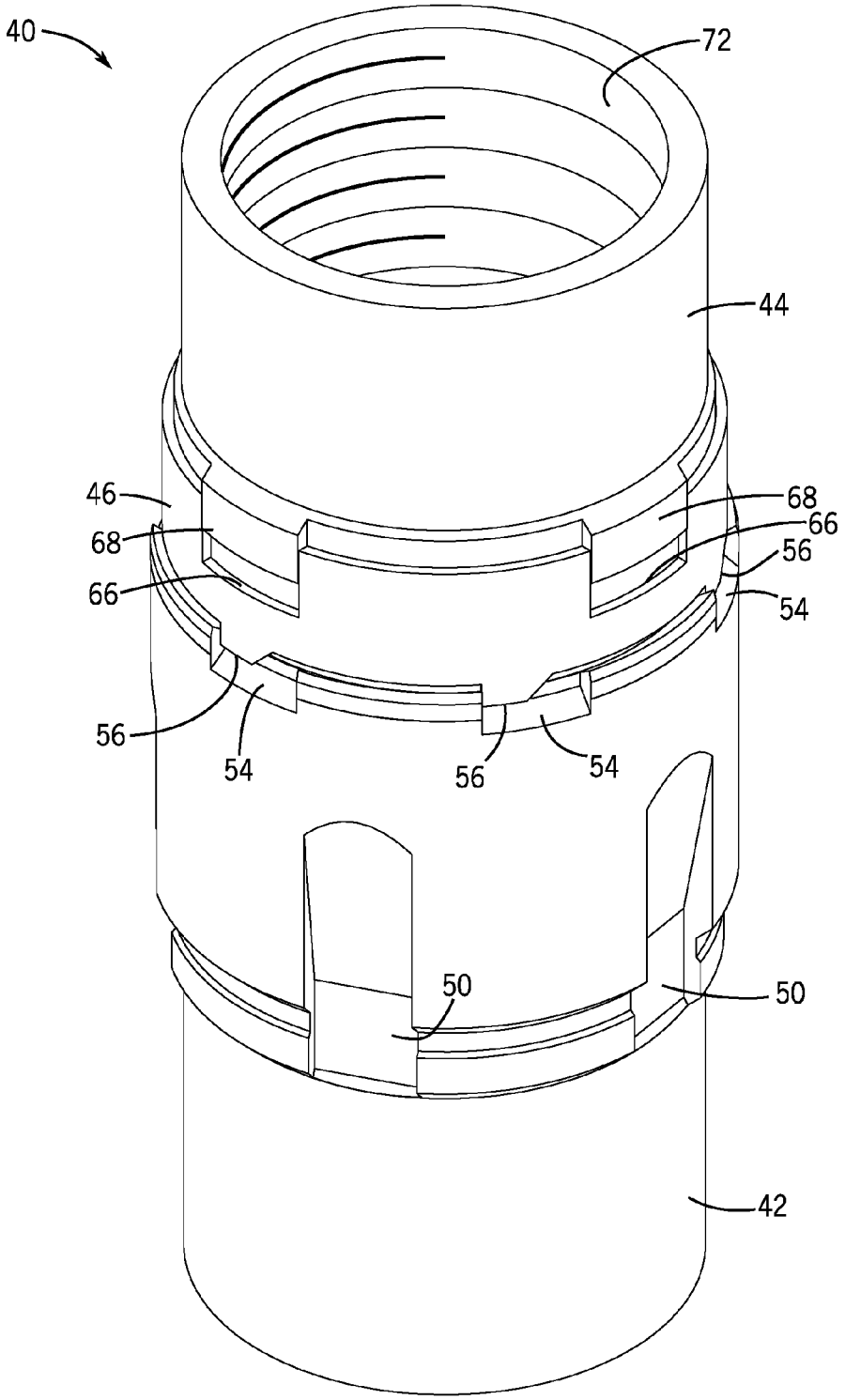
FIG. 2 is a perspective view of a wellhead hanger assembly including a wellhead hanger, a running tool, and a torque sleeve for transmitting torque from the running tool to the wellhead hanger in accordance with one embodiment.

One example of a wellhead hanger assembly 40 is generally depicted in FIGS. 2-12. As shown in FIG. 2, the assembly 40 includes a wellhead hanger 42 (provided here as a mandrel-type casing hanger) coupled to a running tool 44. A torque sleeve 46 of the assembly 40 is positioned to transmit torque from the running tool 44 to the wellhead hanger 42. In at least some embodiments, including that shown in FIG. 2, the torque sleeve 46 is in castellated engagement with the running tool 44 and with the wellhead hanger 42. And as described in further detail below, the castellated engagement of the torque sleeve 46 with the running tool 44 and the wellhead hanger 42 allows rotation of the running tool 44 (e.g., by a landing joint) to drive synchronous rotation of the wellhead hanger 42 (and any attached casing string) via the sleeve 46.

Figure 3:
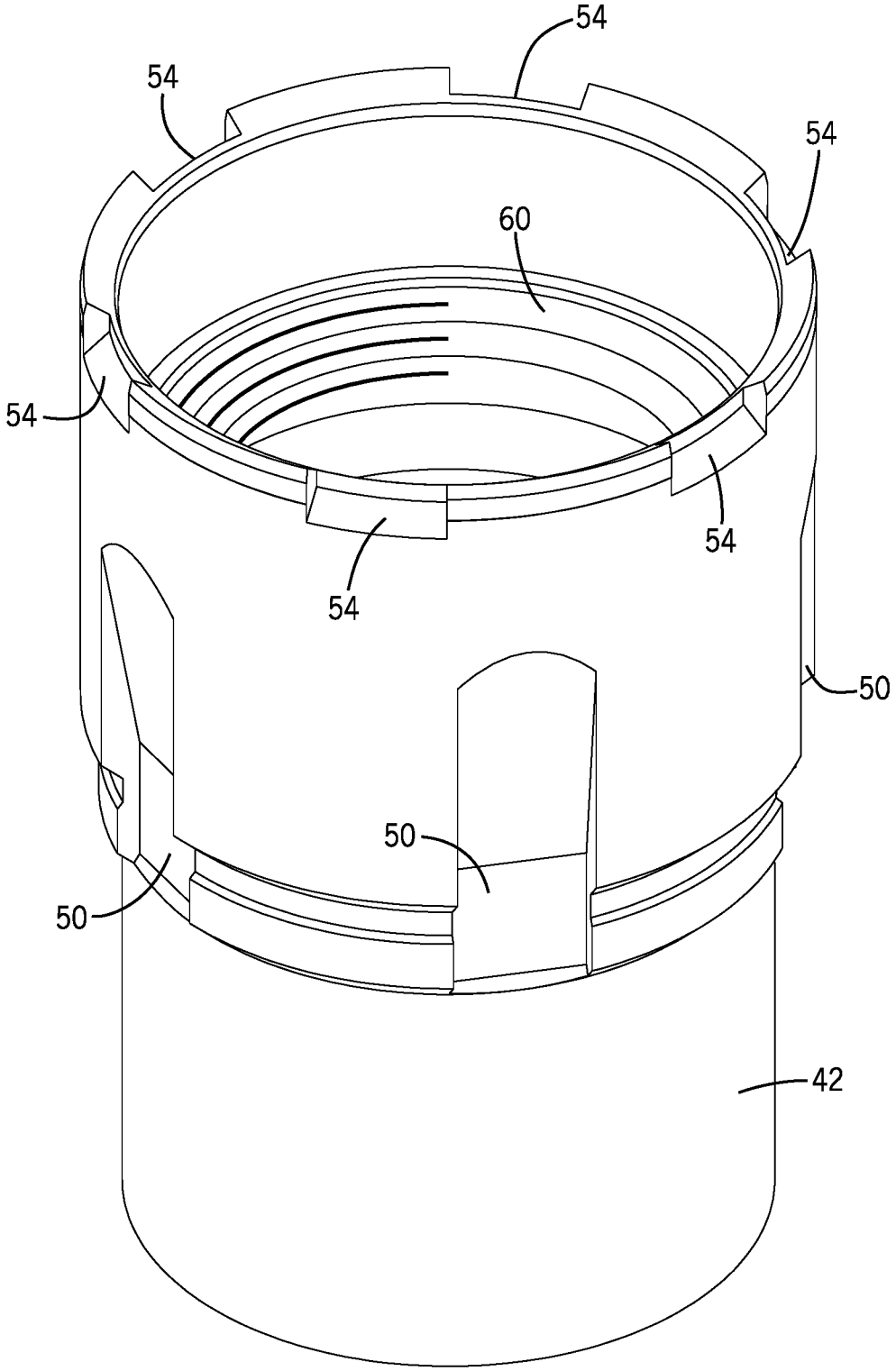
FIG. 3 is a perspective view of the wellhead hanger of FIG. 2.

As best shown in FIG. 3, the wellhead hanger 42 includes slots 50 and 54. In at least some instances, the slots 50 and 54 facilitate the flow of fluid (e.g., drilling mud) past the exterior of the hanger 42 when installed within a wellhead. The slots 54 at the upper end of the hanger 42 receive castellations 56 (which may also be referred to as castellation legs) of the torque sleeve 46. These mating slots and castellations cooperate to transmit torque between the sleeve 46 and the hanger 42 when the running tool 44 is coupled to the hanger 42 as shown in FIG. 2.

The running tool 44 can be coupled to the hanger 42 in any suitable manner. In the presently depicted embodiment, the hanger 42 includes an interior threaded surface 60 (FIG. 3) and the running tool 44 includes a mating, exterior threaded surface 62 (FIG. 4), which allows a lower end of the running tool 44 to be threaded into the upper end of the hanger 42. Further, the surfaces 60 and 62 of this embodiment include mating right-handed threads, although the surfaces could instead include left-handed threads in other embodiments.

Figure 4:
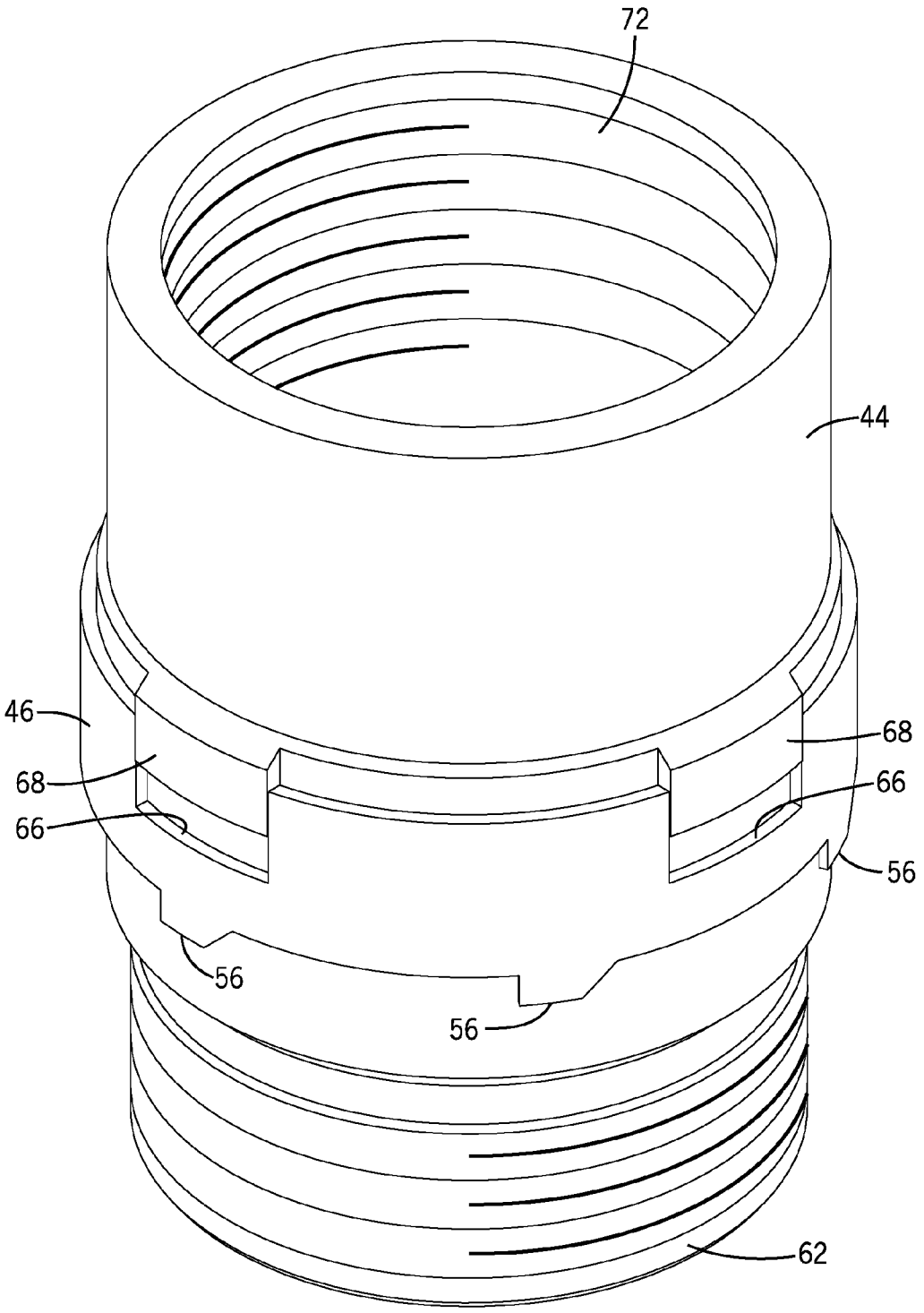
FIG. 4 is a perspective view of the torque sleeve and running tool of FIG. 2.
Figure 5:
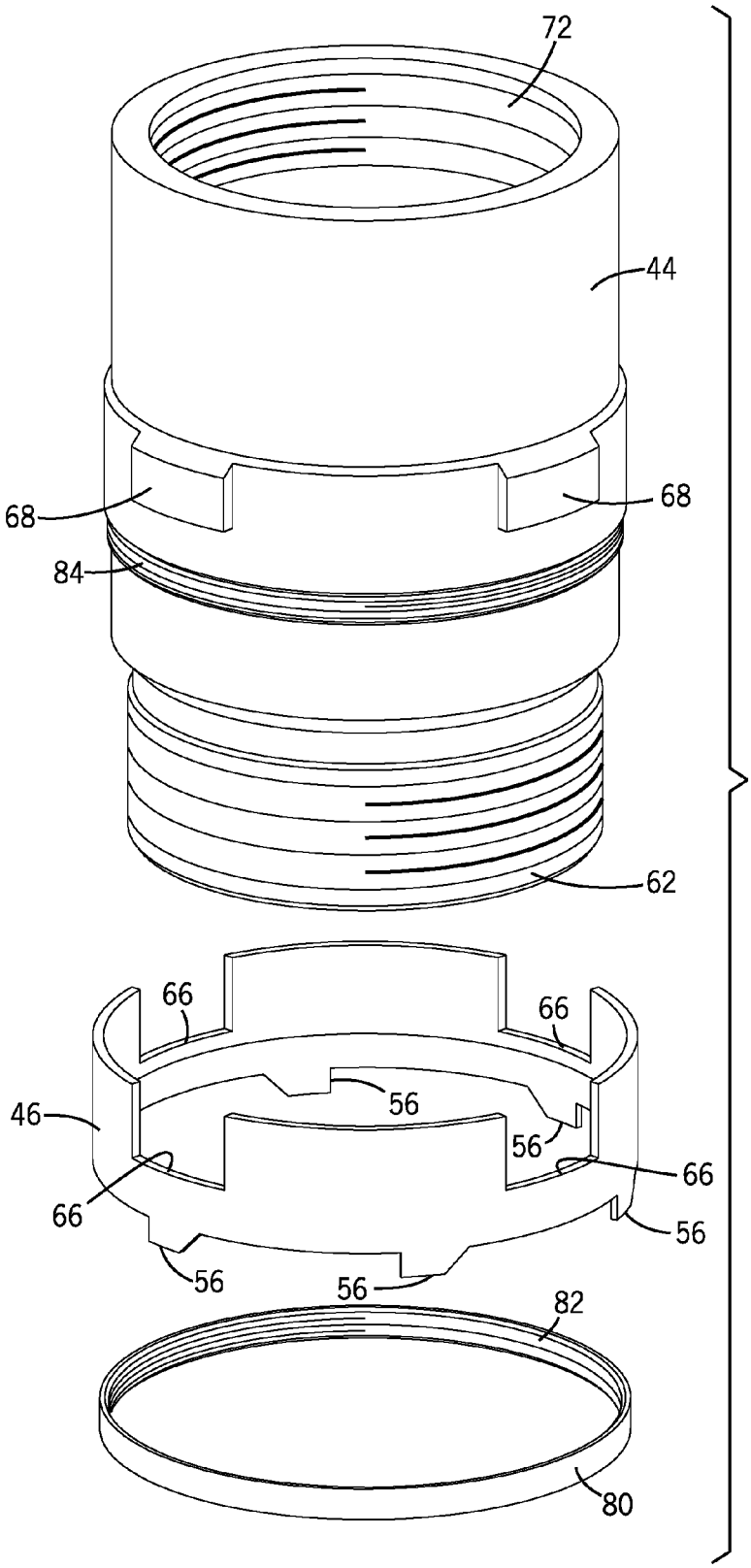
FIG. 5 is an exploded view showing the running tool and torque sleeve of FIG. 2, along with a ring for retaining the torque sleeve on the running tool in accordance with one embodiment.
Figure 6:
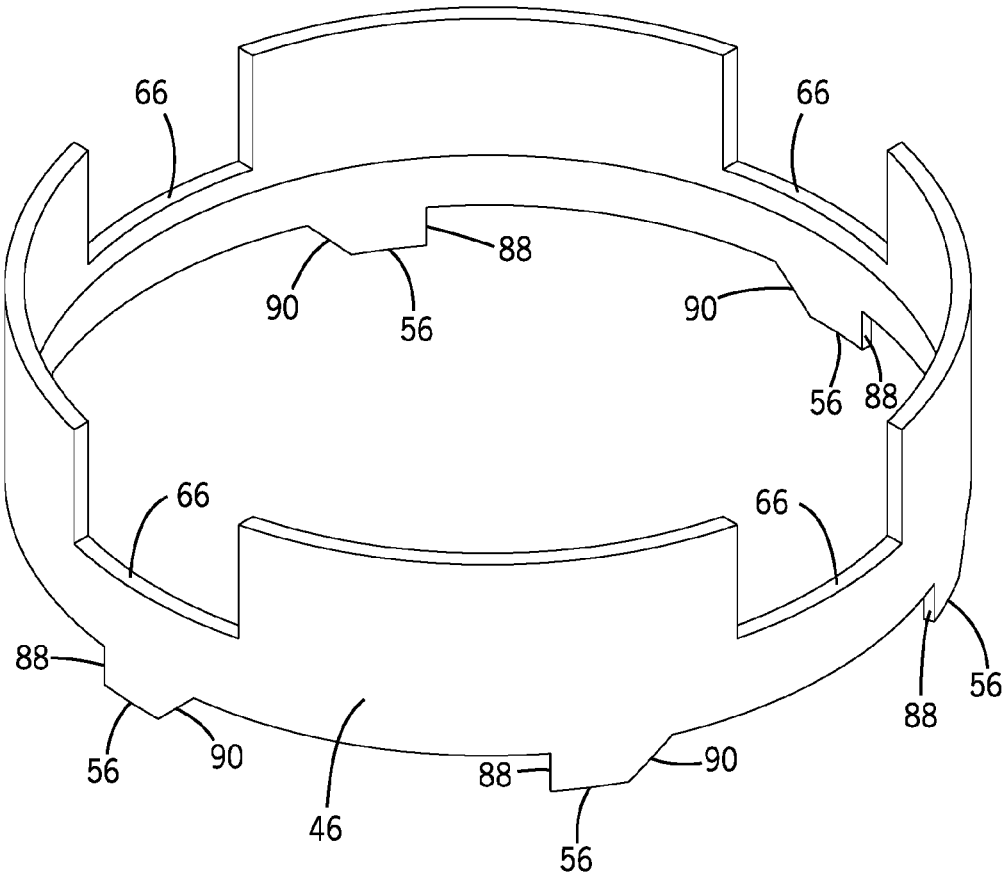
FIG. 6 is a perspective view of the torque sleeve of FIG. 2.
Figure 7:
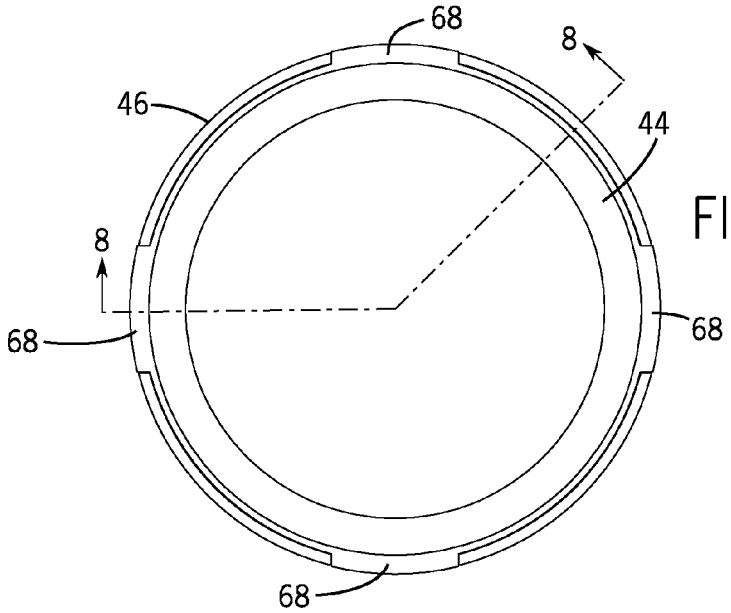
FIG. 7 is a top view of the torque sleeve mounted on the running tool as shown in FIG. 4.

An additional set of castellations and mating slots are provided for transmitting torque from the running tool 44 to the torque sleeve 46. As shown in FIGS. 4-6, the torque sleeve 46 includes slots 66 for receiving castellations 68 of the running tool 44. When these castellations 68 are received within the slots 66, rotation of the running tool 44 (e.g., by a landing joint threaded into the running tool 44 at threaded surface 72) causes the castellations 68 to push against sides of the slots 66 to drive rotation of the sleeve 46 with the running tool 44. And as noted above, such rotation of the sleeve 46 via the running tool 44 also causes rotation of the wellhead hanger 42 through interaction of the castellations 56 and slots 54.

During assembly, the torque sleeve 46 can be placed about the lower end of the running tool 44 and moved axially along the running tool 44 so that the castellations 68 are received in the slots 66. The torque sleeve 46 may be retained on the running tool 44 in various manners. The presently depicted assembly 40, for example, includes a retaining ring 80 that can be coupled to the running tool 44 (e.g., by mating threaded surfaces 82 and 84) to retain the sleeve 46 on the running tool 44.

Figure 8:
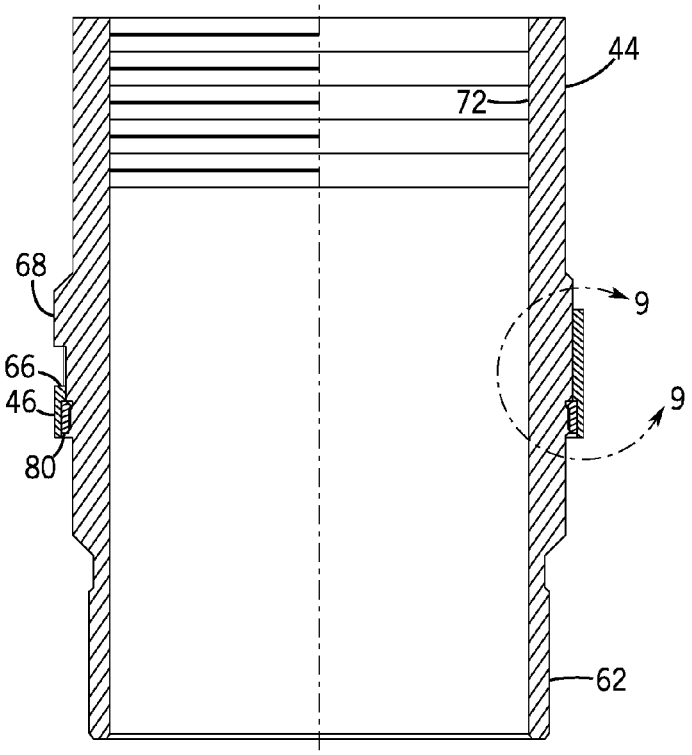
FIGS. 8 and 9 generally depict the retention of the torque sleeve on the running tool by the retaining ring of FIG. 5 in accordance with one embodiment.
Figure 9:
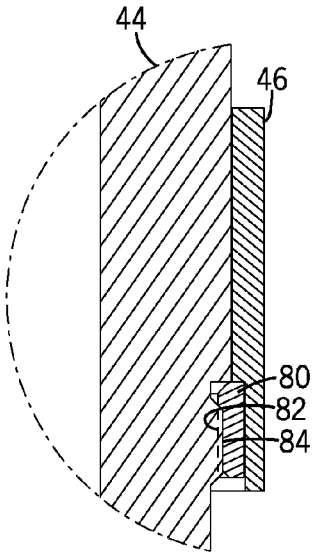
Figure 10:
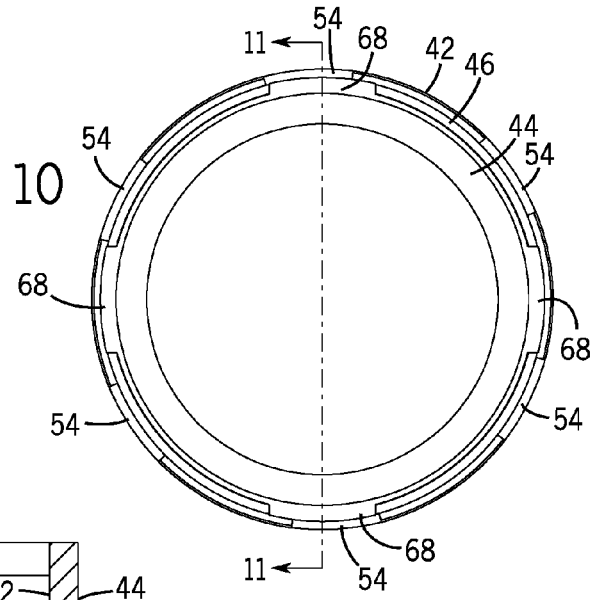
FIGS. 10-12 are additional views of the assembly depicted in FIG. 2 in accordance with one embodiment.
Figure 11:
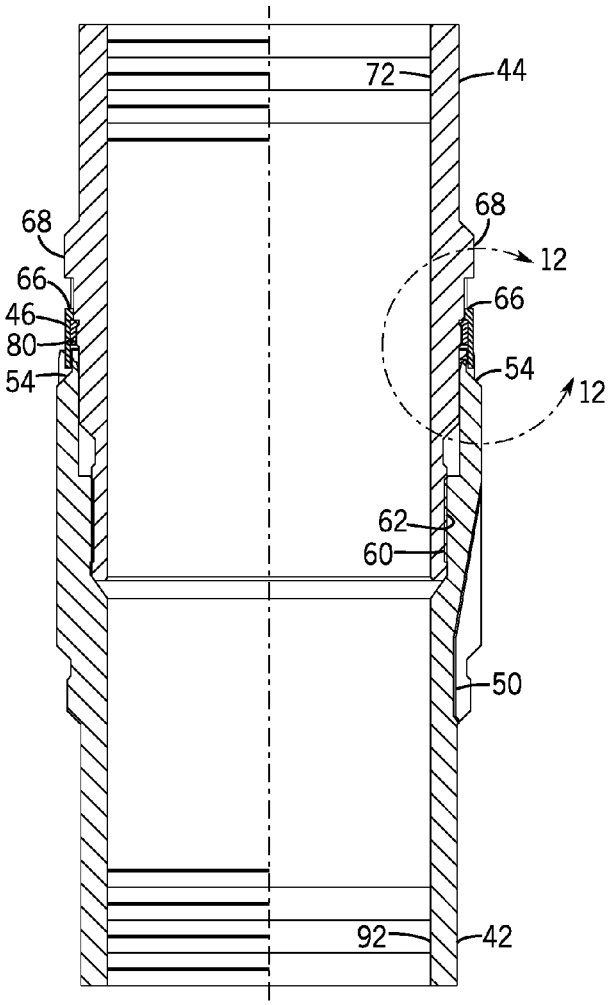
Figure 12:
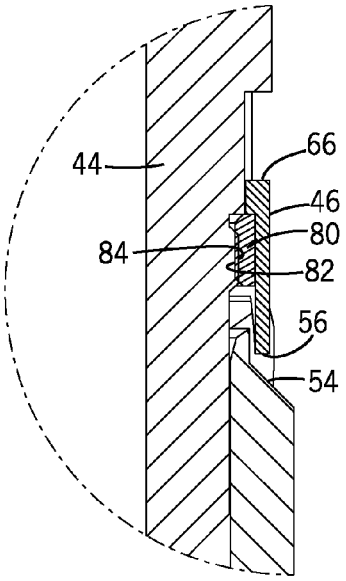

The installed retaining ring 80 and the castellations 68 are positioned apart in a manner that allows the sleeve 46 to be moved axially along the body of the running tool 44, with the extent of the sleeve travel limited by the castellations 68 in one direction and the retaining ring 80 in the opposite direction. This may be better appreciated with reference to the various views of the sleeve 46 positioned on the running tool 44 provided in FIGS. 7-11. When the running tool 44 is in an upright position, gravity on the sleeve 46 generally causes an internal shoulder of the sleeve 46 to rest against the retaining ring 80, as shown in FIGS. 8 and 9. While the section views of FIGS. 8 and 9 do not show castellations 56 of the sleeve 46, a different plane through the assembly 40 is used to show these castellations in FIGS. 11 and 12. When retained in this way on the running tool 44, coupling of the running tool 44 to the hanger 42 causes the sleeve 46 to be interposed between the castellations 68 of the running tool 44 and the slots 54 of the hanger 42, as generally depicted in FIGS. 2, 11, and 12.

Engagement of the castellations 56 with the slots 54 allows the hanger 42 to be rotated via the sleeve 46. Although the castellations 56 can have any suitable shape, in at least some embodiments the castellations 56 are shaped so as to transmit torque and drive synchronous rotation of the wellhead hanger 42 with the sleeve 46 when the sleeve 46 is rotated in one direction, but not when the sleeve 46 is rotated in an opposite direction. Such castellations 56 can be referred to as one-way castellations.

By way of example, as shown in FIG. 6 the castellations 56 each include a stop shoulder 88 and an angled return surface 90. Clockwise rotation of the sleeve 46 (which may itself be driven through castellated engagement with the running tool 44, as noted above) causes the stop shoulders 88 to engage sides of the slots 54 in the wellhead hanger 42 and drive rotation of the hanger 42 with the sleeve 46. A tubular string (e.g., a casing string) can be suspended from the hanger 42 (e.g., via mating engagement with threaded surface 92) such that this tubular string rotates with the hanger 42.

Counter-clockwise rotation of the sleeve 46, however, causes the angled return surfaces 90 of the castellations 56 to contact opposite sides of the slots 54. As the sleeve 46 continues to rotate counter-clockwise, the movement of the angled surfaces 90 against the sides of the slots 54 causes those sides to push the castellations 56 out of the slots 54 and to disengage the sleeve 46 from the hanger 42 by lifting the sleeve 46 along the body of the running tool 44. This enables further counter-clockwise rotation of the sleeve 46 (and the tool 44), thus allowing the tool 44 to be unthreaded from the hanger 42. In another embodiment, the slots 54 could instead include the angled return surfaces for pushing the castellations 56 out of the slots 54 upon counter-clockwise rotation of the sleeve 46.

Although certain examples of castellations and slots are illustrated in the present figures and described herein with respect to the hanger assembly 40, it will be appreciated that these castellations and slots could take other forms or be provided in different numbers. As shown in FIG. 2, for example, the castellations 56 protrude axially from a lower end of the sleeve 46 into slots 54 in an exterior surface of the hanger 42, and the castellations 68 protrude radially from the running tool 44 into the slots 66 in an upper end of the sleeve 46. In some other instances, however, the castellations and slots may be provided in other ways, such as the lower end of the sleeve 46 having slots to receive castellations of the hanger 42. Likewise, the upper end of the sleeve 46 could have castellations received in slots of the running tool 44. In still further embodiments, the torque sleeve 46 can transmit torque from the running tool 44 to the hanger 42 through non-castellated engagement of the sleeve 46 with the tool 44 or the hanger 42 (e.g., with keyed engagement).

Figure 13:
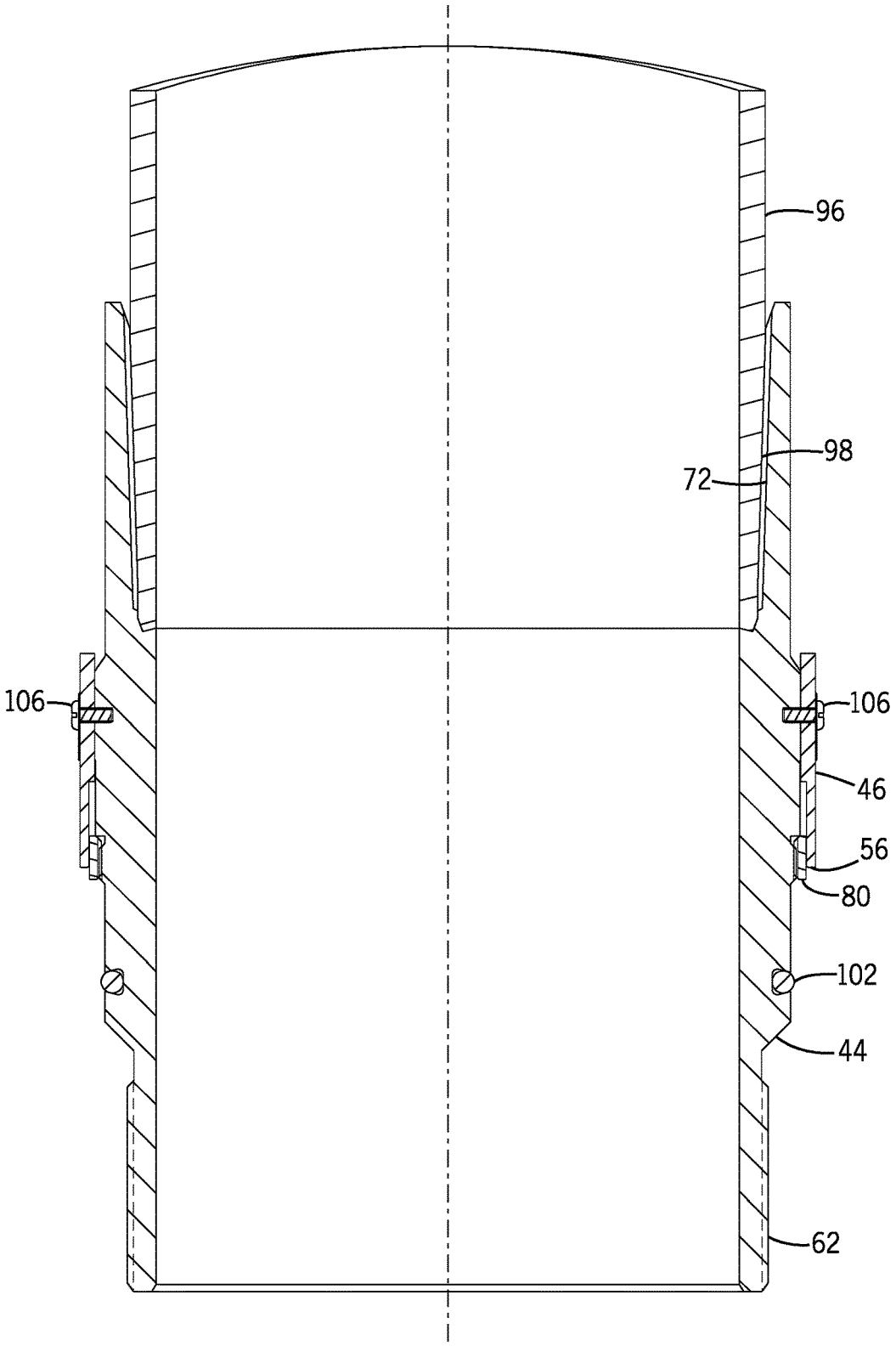
FIGS. 13-17 generally depict assembly of a torque sleeve, a running tool, and a wellhead hanger, and running of the wellhead hanger into a wellhead housing in accordance with one embodiment.

FIGS. 13-17 generally depict aspects of a running procedure for installing the wellhead hanger 42 in a wellhead in accordance with one embodiment. As shown in FIG. 13, a landing joint 96 includes a threaded surface 98 and is coupled to the running tool 44 via mating engagement of this surface 98 with the threaded surface 72 of the tool 44. That is, a lower end of the landing joint 96 can be threaded into the upper end of the tool 44. It will be appreciated that the upper end of the landing joint 96 can be coupled to another component (e.g., a top drive), such that the running tool 44 can be lowered into a wellhead and rotated via the landing joint 96. The running tool 44 is also depicted in FIG. 13 as including an o-ring or some other seal 102 for sealing against the wellhead hanger 42 when the running tool 44 is threaded or otherwise coupled to the hanger 42.

As noted above, the torque sleeve 46 can be positioned on the running tool 44 so that the slots 66 receive the tool castellations 68, and the ring 80 can be threaded to the tool 44 to retain the sleeve 46. If the torque sleeve 46 were simply allowed to hang from the retaining ring 80 during threading together of the tool 44 and the hanger 42, the castellations 56 could prematurely engage the slots 54 of the hanger 42 and prevent a desired amount of mating engagement between the threaded surfaces 60 and 62 of the hanger 42 and the running tool 44. Accordingly, in at least one embodiment the sleeve 46 is lifted off the retaining ring 80 and held in this lifted position to facilitate assembly. As shown in FIG. 13, the sleeve 46 is secured to the running tool 44 in this lifted position by bolts 106, but the sleeve 46 could be held in any other suitable fashion.

Figure 14:
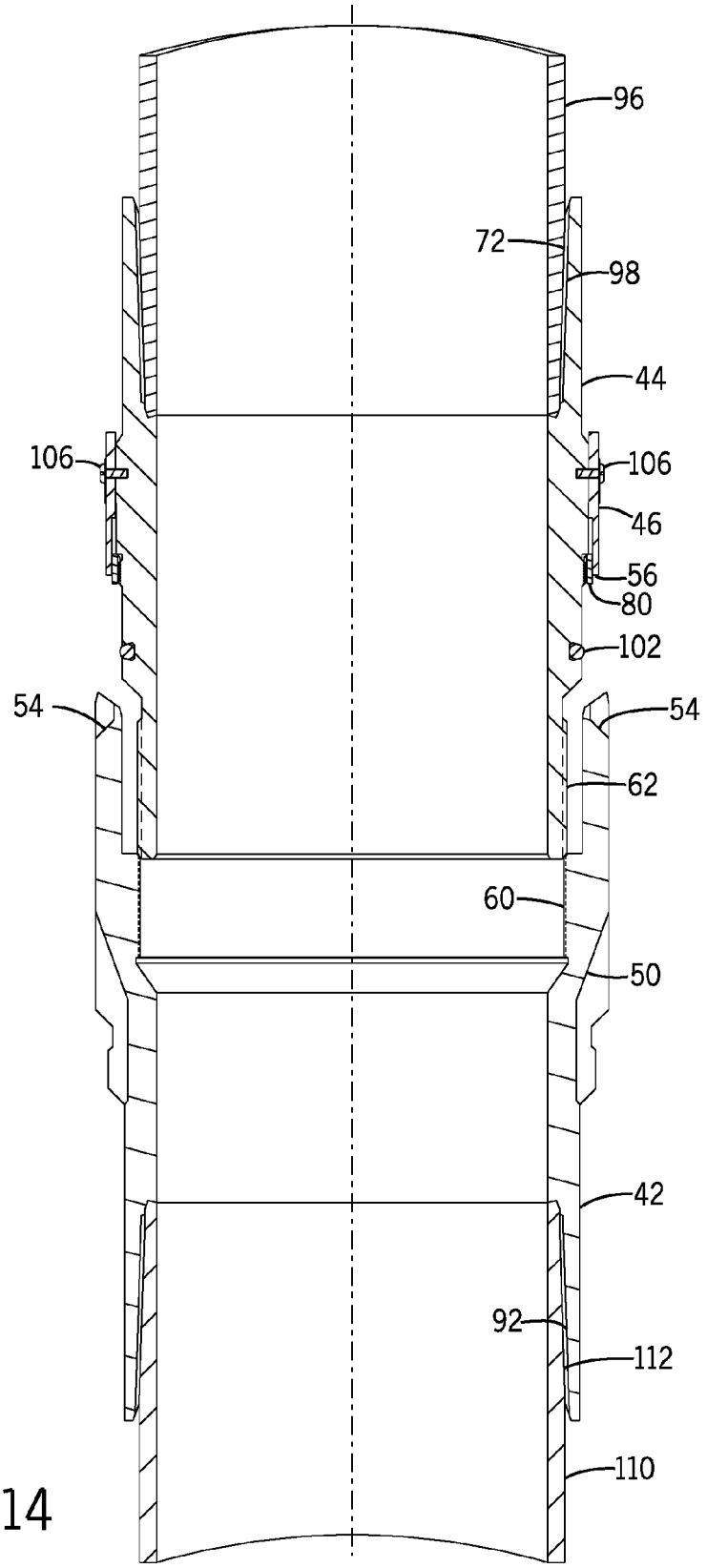
Figure 15:
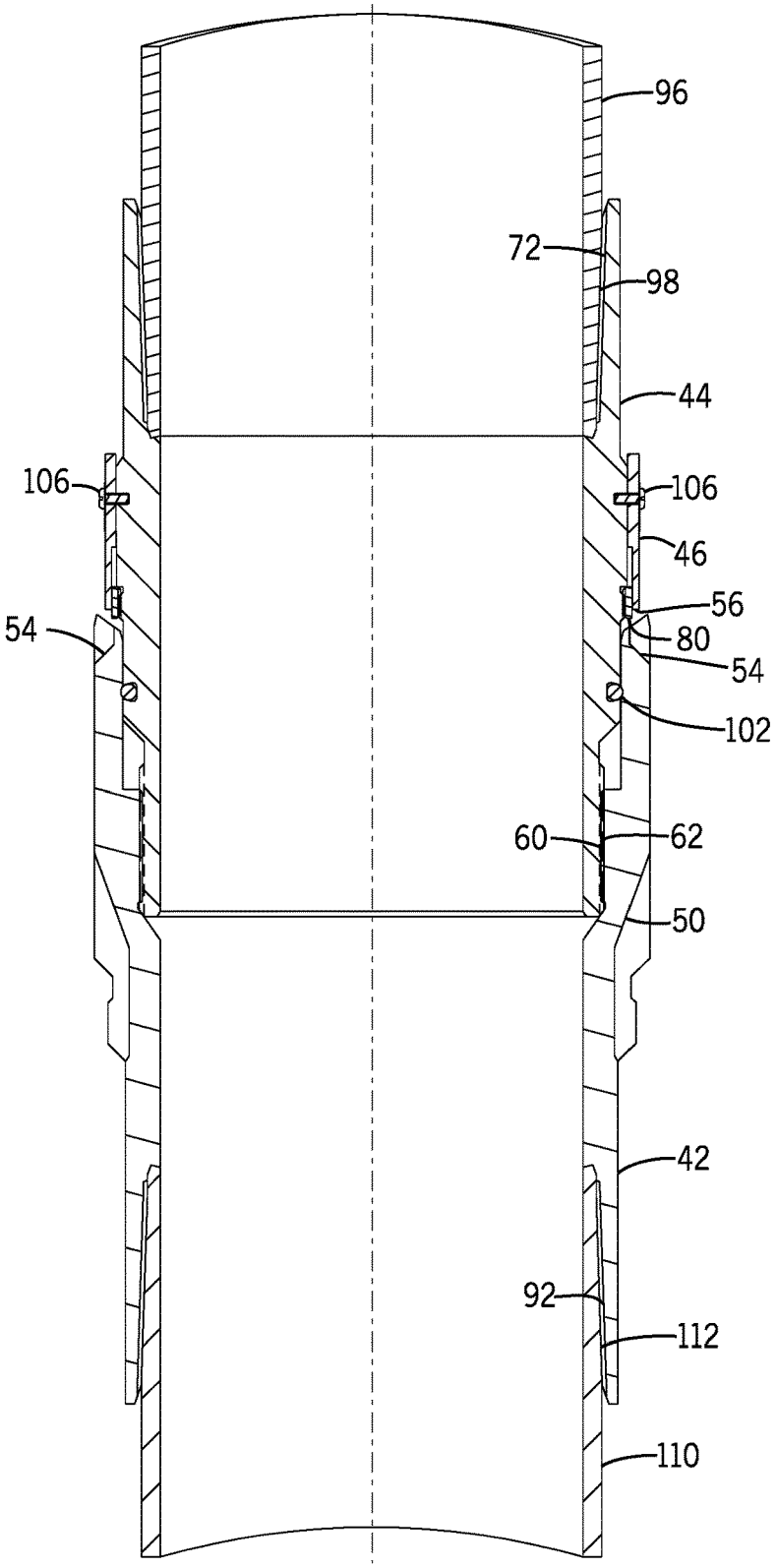

After mounting the torque sleeve 46 on the running tool 44, the running tool 44 can be lifted (via the landing joint 96) and lowered into the hanger 42 to bring the mating threads of surfaces 60 and 62 into contact, as shown in FIG. 14. In this depicted embodiment, the hanger 42 is coupled to a casing string 110 via mating engagement of threaded surfaces 92 and 112. The running tool 44 can then be rotated to thread the running tool 44 to the hanger 42, as shown in FIG. 15. For instance, in the case of right-handed threaded surfaces 60 and 62, the running tool 44 can be rotated clockwise until the surfaces 60 and 62 are fully mated and a positive stop occurs.

Figure 16:
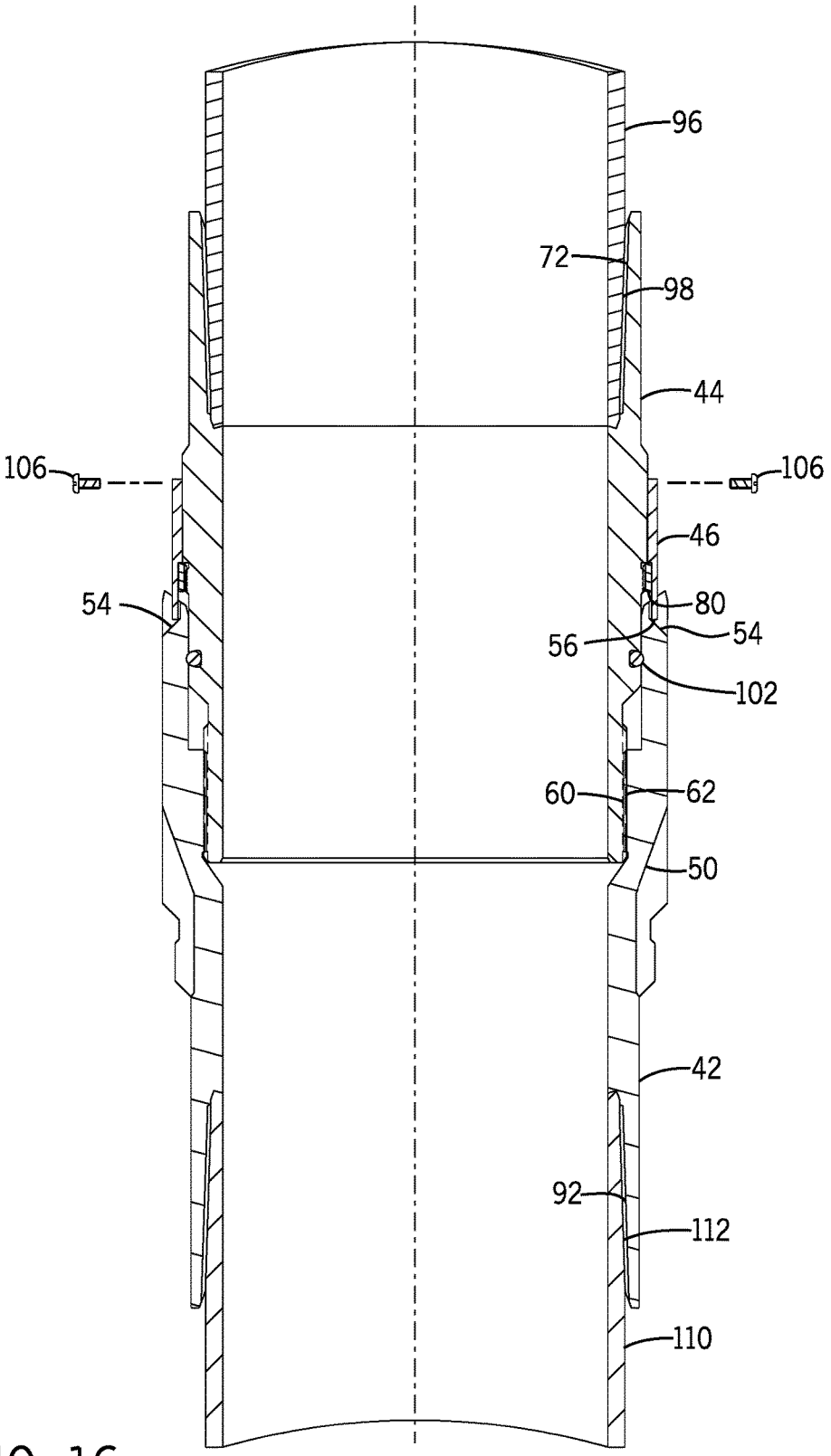

At this point, the castellations 56 of the sleeve 46 may not be circumferentially aligned with the mating slots 54 of the hanger 42. In such an event, the running tool 44 can be backed off slightly (e.g., by less than a quarter turn counter-clockwise) to align the castellations 56 with the slots 54. Next, the bolts 106 can be removed to allow the sleeve 46 to be moved downward (e.g., by gravity or by an operator) so that the castellations 56 extend into the slots 54, as depicted in FIG. 16. It is noted that the retaining ring 80 can provide a positive stop to the downward movement of the torque sleeve 46.

Figure 17:
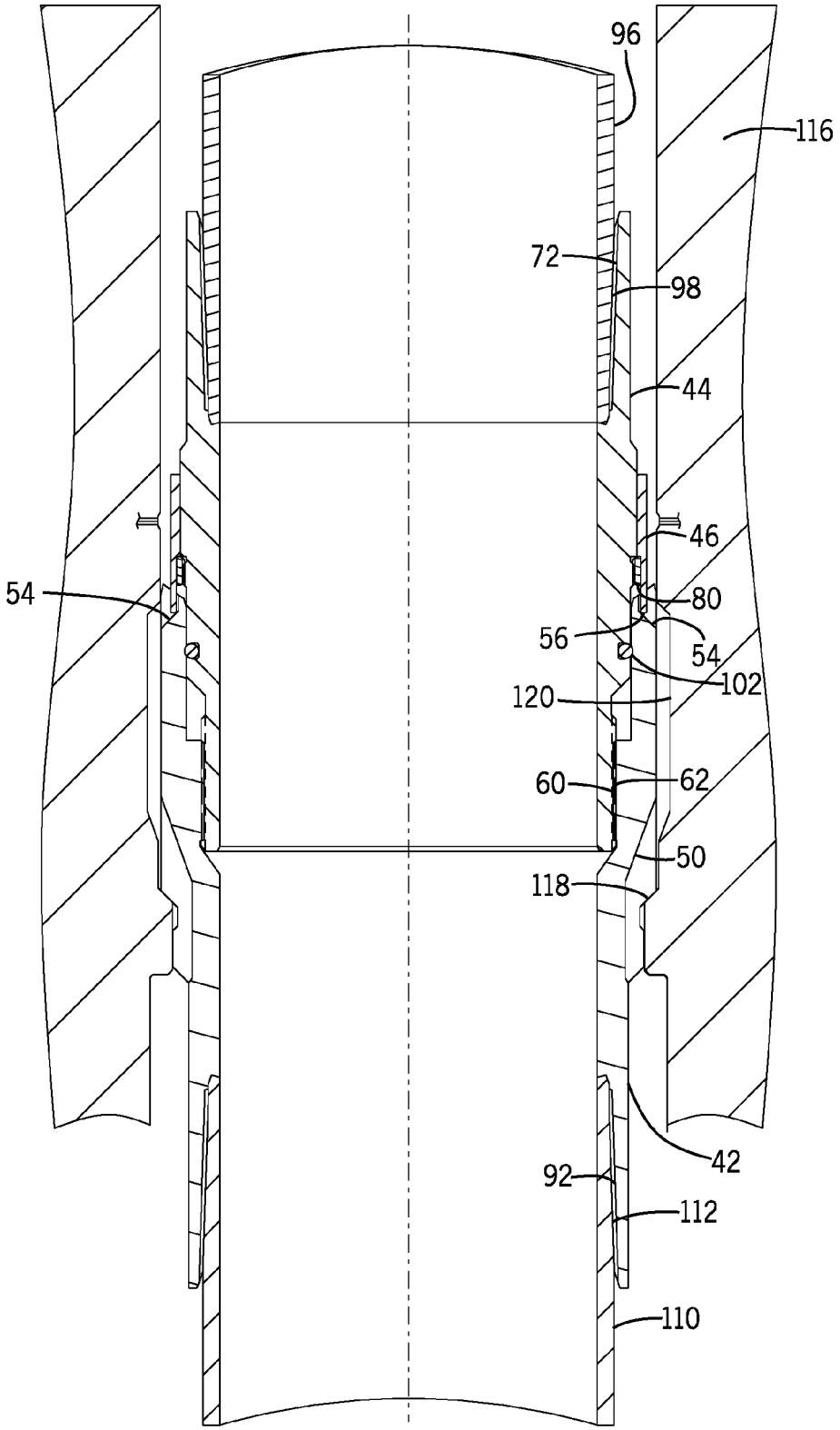
Figure 18:
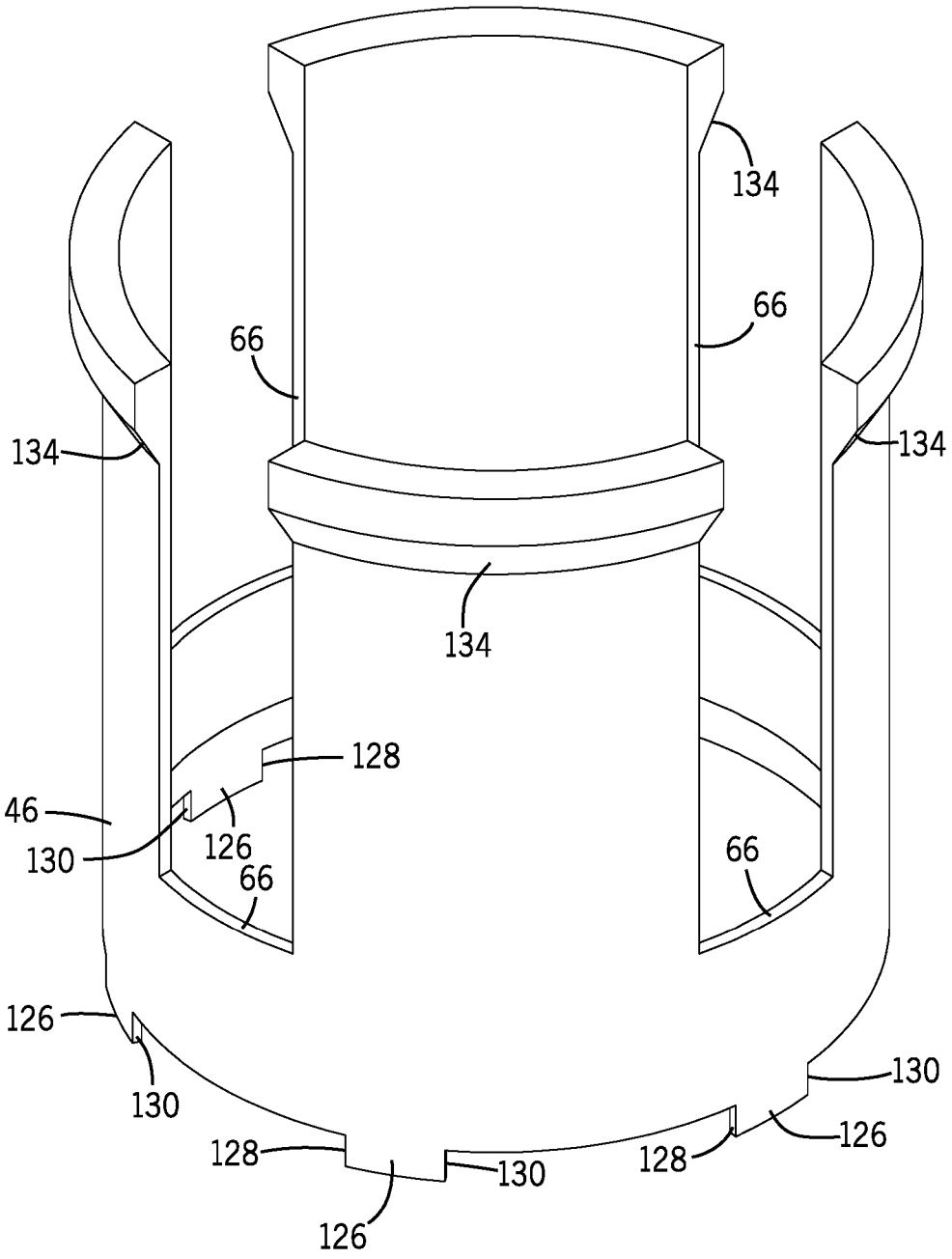
FIG. 18 is a perspective view of a torque sleeve that can be used to transmit torque from a running tool to a wellhead hanger and to indicate whether the wellhead hanger is positioned at a desired location in a wellhead housing in accordance with one embodiment.

The hanger 42 can then be lowered into a wellhead housing 116 (e.g., a casing head) and landed on a shoulder 118, such as generally shown in FIG. 17. The depicted wellhead housing 116 includes a recess 120 to facilitate fluid flow between the flow-by slots 50 and 54 about the exterior of the hanger 42. In some instances, such as in some cementing operations, the hanger 42 and attached casing string 110 are rotated by the running tool 44 via the sleeve 46. Through mating engagement of the castellations 56 and the slots 54, the sleeve 46 transmits torque from the running tool 44 to the hanger 42 when the running tool 44 is rotated. More particularly, in at least some embodiments this engagement of the sleeve 46 with the hanger 42 prevents over-tightening of the threaded interface (at surfaces 60 and 62) between the running tool 44 and the hanger 42 from such rotation. Such over-tightening could otherwise cause excessive friction between the threaded surfaces 60 and 62, increase the break-out torque needed to overcome this friction, and frustrate disconnection and retrieval of the running tool 44 from the hanger 42 after it is run into the wellhead housing 116. This transmission of torque from the sleeve 46 to the hanger 42 reduces the break-out torque needed to disconnect the running tool 44. The running tool 44 can be retrieved by rotating the tool 44 counter-clockwise to unthread the tool 44 from the hanger 42. As noted above, the angled return surfaces 90 of the castellations 56 allow the slots 54 to push the sleeve 46 upward along the tool 44 during initial disconnection of the tool 44.

Another embodiment of the torque sleeve 46 is generally depicted in FIGS. 18-23. Rather than having one-way castellations 56, the torque sleeve 46 in FIG. 18 includes two-way castellations 126 for transmitting torque to the hanger 42 when rotated in either direction. More particularly, the castellations 126 can be received in the slots 54 of the hanger 42, as generally described above, and include opposing edges 128 and 130 for engaging the sides of the slots 54 and driving synchronous rotation of the hanger 42 (in either direction) with the sleeve 46.

Assembly of the hanger 42, running tool 44, and this sleeve 46 may be accomplished in a manner like that described above, including retaining the sleeve 46 in a lifted position while threading the running tool 44 to the hanger 42. In contrast, however, the threaded surfaces 60 and 62 of at least one embodiment include left-handed threads, rather than right-handed threads (though right-handed threads could be used in some other embodiments of this sleeve 46 with castellations 126). When left-handed threads are used for surfaces 60 and 62, the running tool 44 is rotated counter-clockwise to mate threaded surfaces 60 and 62 and join the tool 44 to the hanger 42. The sleeve 46 may then be moved downward along the body of the running tool 44 to insert the castellations 126 into the slots 54 of the hanger 42. In this position, the two-way castellations 126 in the slots 54 allow torque transmission from the sleeve 46 to the hanger 42 when the sleeve 46 is rotated in either direction; the sides of the slots 54 cooperate with the castellations 126 such that clockwise rotation of the running tool 44 drives synchronous rotation of the hanger 42, preventing relative rotation between the tool 44 and the hanger 42 instead of unthreading the tool 44 from the hanger 42.

Figure 19:
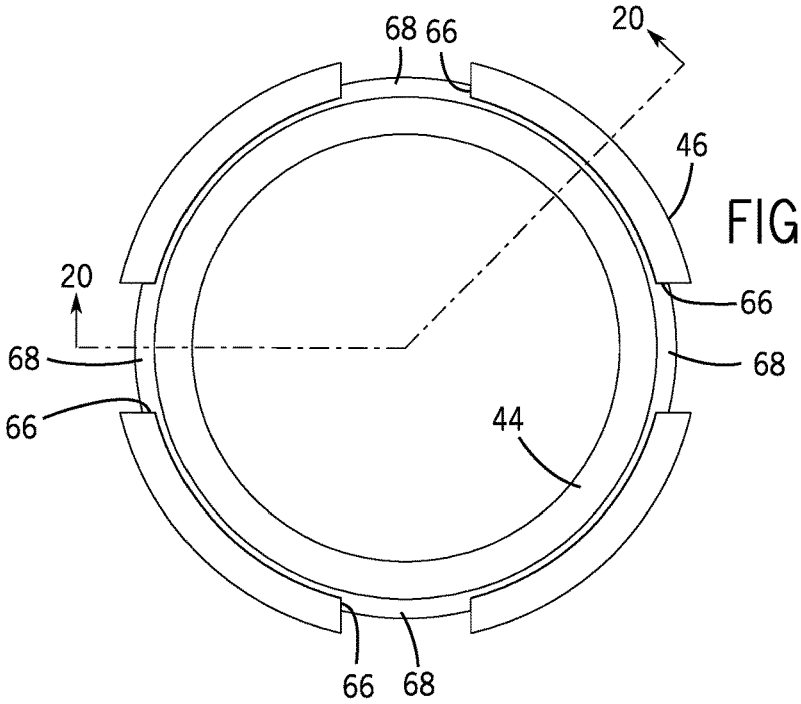
FIGS. 19 and 20 depict the torque sleeve of FIG. 18 mounted on a running tool in accordance with one embodiment.
Figure 20:
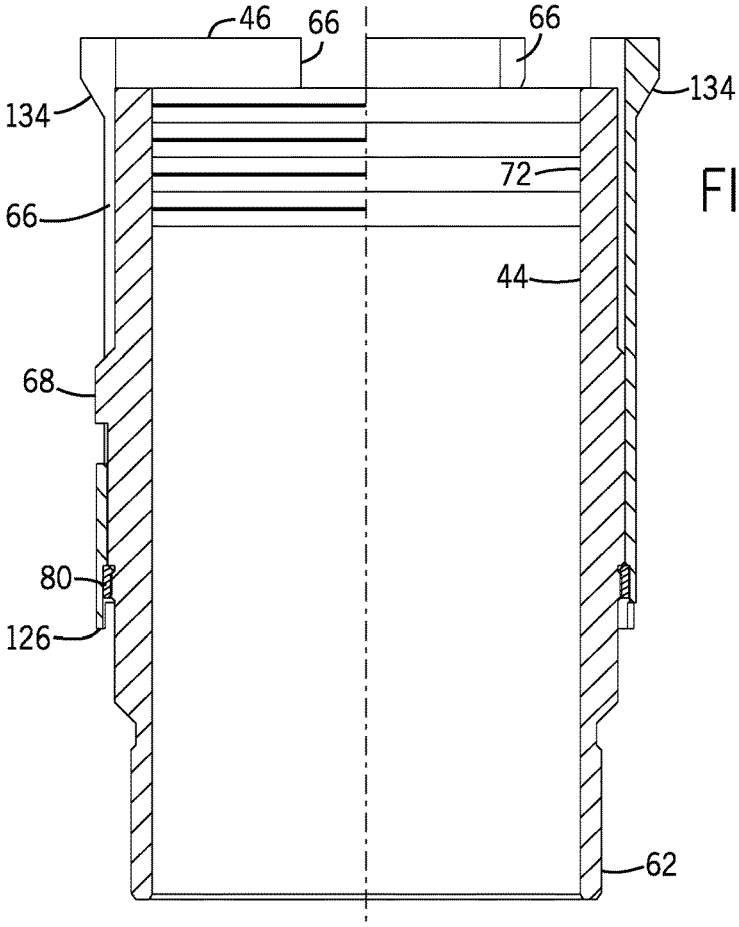

The sleeve 46 depicted in FIGS. 18-23 also includes a radial protrusion (here a segmented shoulder 134) for engaging a mating feature of a wellhead housing 116. As shown in FIGS. 19 and 20, the shoulder 134 protrudes radially outward further than the castellations 68 of the running tool 44. This allows the castellations 68 to freely pass the mating feature of the wellhead housing 116 when the hanger 42 is lowered into the housing, while the shoulder 134 lands on the mating feature and is prevented from further downward travel through the housing, as described further below. In addition to locking the running tool 44 to the hanger 42 and transmitting torque, the sleeve 46 can also function as a landing indicator to enable an operator to verify whether a hanger 42 run into the wellhead housing 116 has landed on the landing shoulder 118. This functionality may be better understood with reference to FIGS. 21-23, which show the hanger assembly (including the sleeve 46 of FIG. 18) as it is lowered into the wellhead housing 116.

Figure 21:
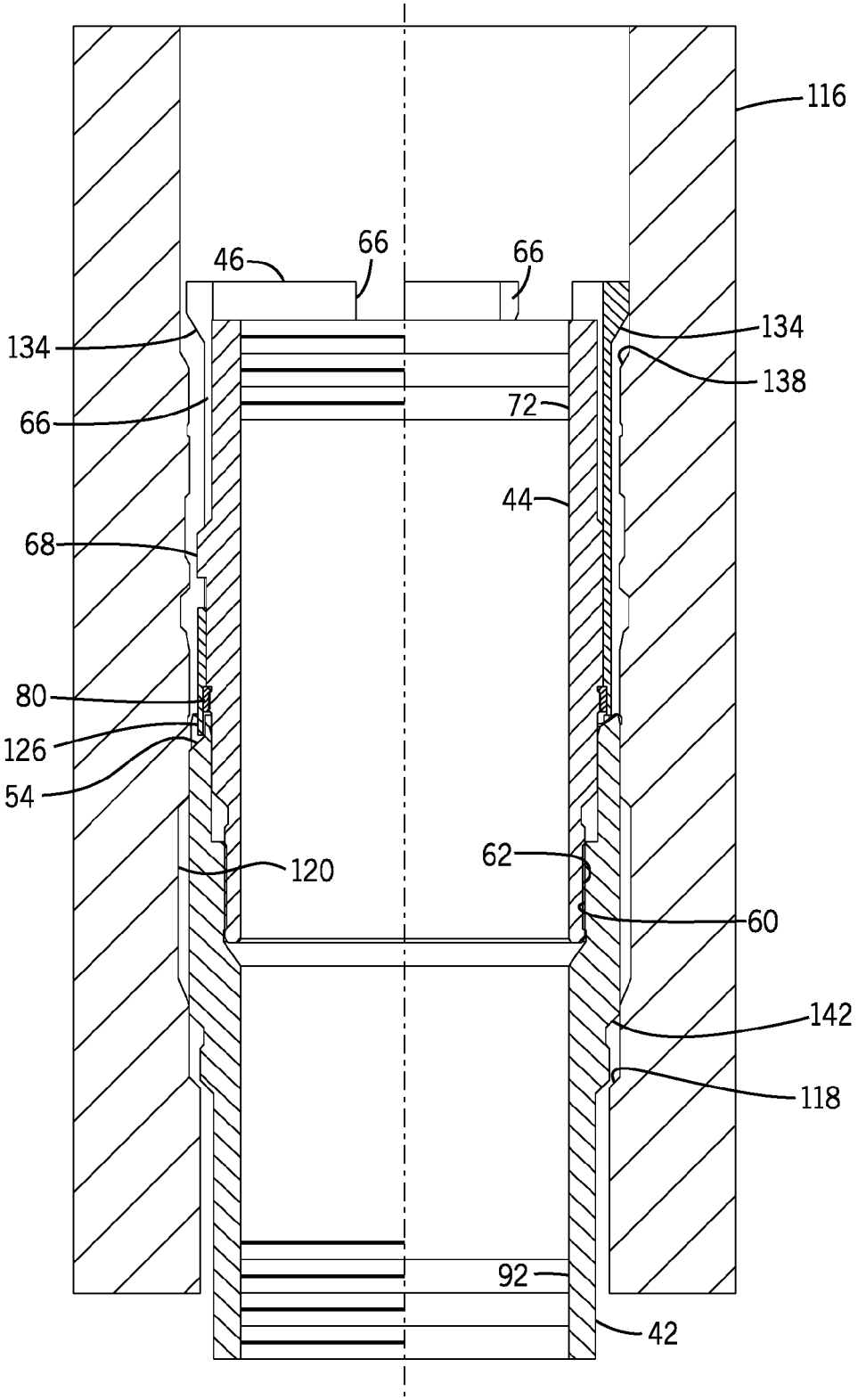
FIGS. 21-23 represent the lowering of a wellhead hanger with the running tool and torque sleeve of FIGS. 19 and 20 into a wellhead housing in accordance with one embodiment.
Figure 22:
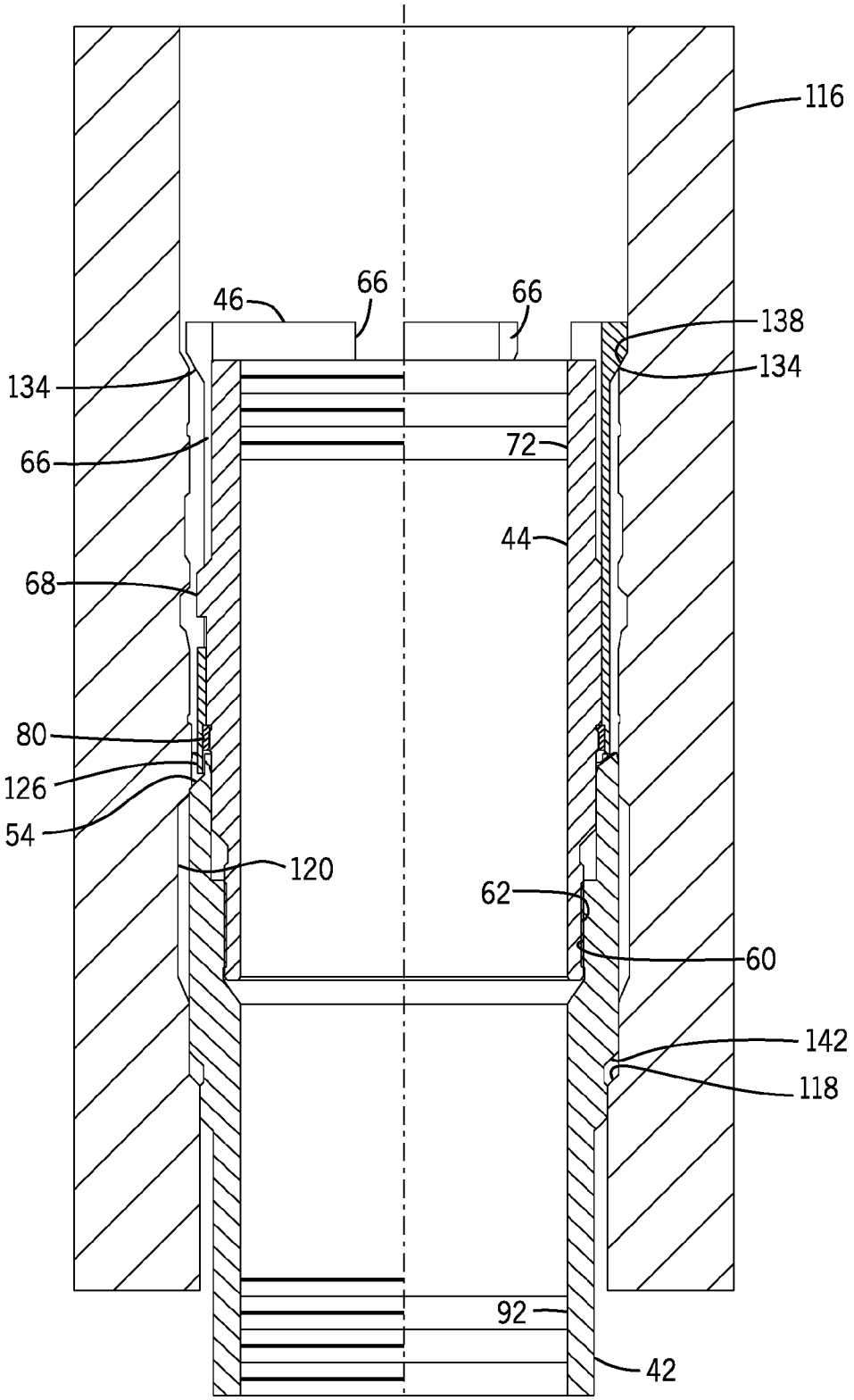
Figure 23:
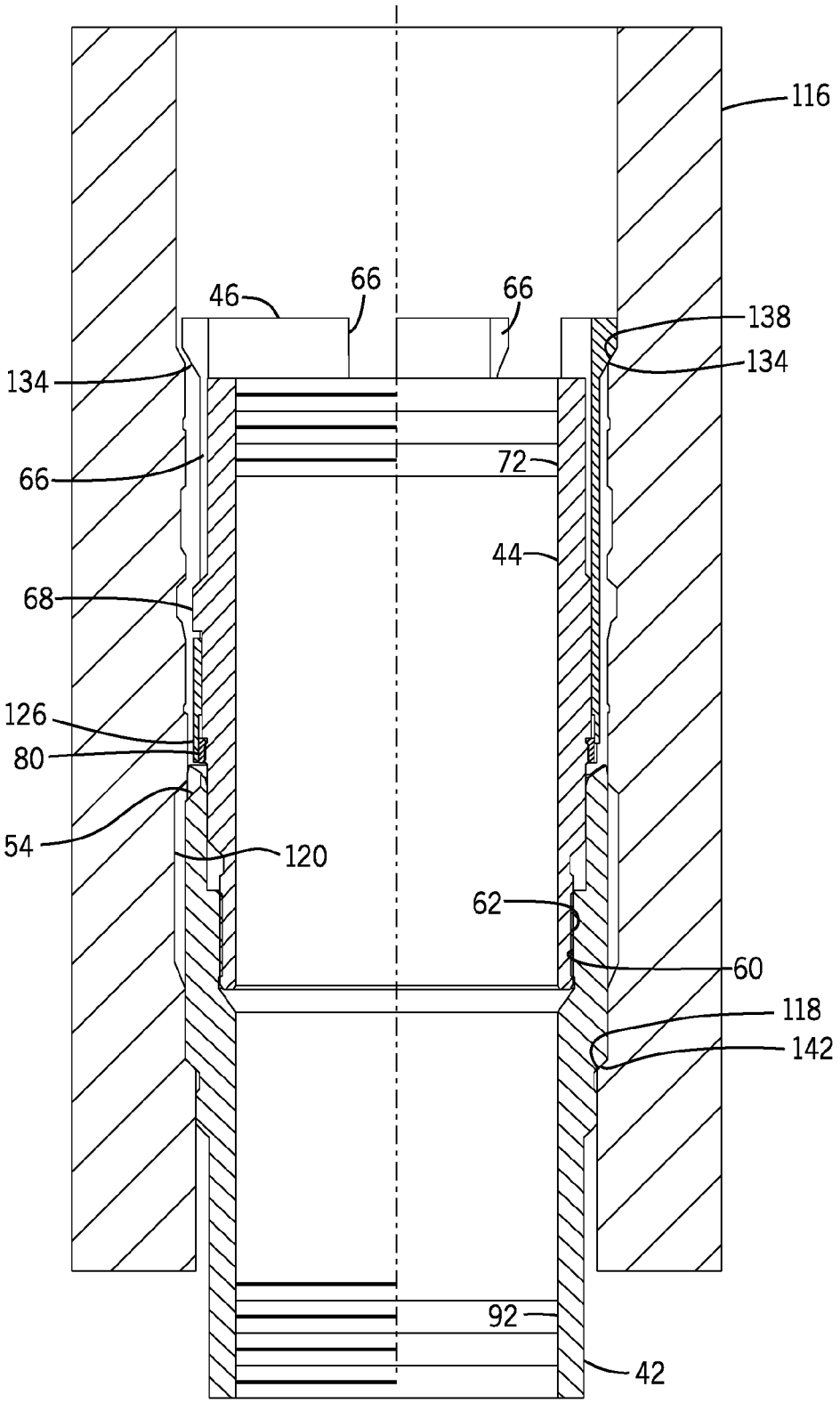

As the assembly is first lowered into the housing 116, the shoulder 134 of the sleeve 46 is positioned at a distance above a mating stop shoulder 138 of the housing, while a shoulder 142 of the hanger 42 is positioned at a greater distance above the landing shoulder 118 of the housing, as generally depicted in FIG. 21. Further downward movement of the assembly causes the shoulder 134 of the sleeve 46 to land on the mating stop shoulder 138 of the housing 116 before the shoulder 142 of the hanger 42 lands on its mating landing shoulder 118, as shown in FIG. 22. Engagement of the shoulders 134 and 138 prevent any further downward movement of the sleeve 46, while allowing the hanger 42 and the running tool 44 to continue their descent through the housing 116 until, as shown in FIG. 23, the hanger shoulder 142 lands on the shoulder 118.

The continued descent of the running tool 44, after the downward movement of the sleeve 46 is stopped by the shoulder 138, causes the hanger 42 to disengage from the sleeve 46 once the hanger reaches its landed position within the housing 116. That is, once the sleeve 46 is stopped by the shoulder 138, downward movement of the hanger 42 to land on the shoulder 118 causes the castellations 126 to be pulled from the slots 54. This unlocks the running tool 44 from the hanger 42, and the running tool 44 can then be rotated clockwise to unthread the tool 44 from the hanger 42. But until the hanger 42 is moved to its intended installation position within the housing 116, the engagement of the castellations 126 with the slots 54 locks the running tool 44 to the hanger 42 and prevents unthreading of the running tool 44 from the hanger 42. Thus, an operator can discern whether the hanger 42 has landed at a desired location within the housing 116 based on whether the running tool 44 can be unthreaded from the hanger 42 while positioned in the housing 116, with the ability to unthread the tool 44 from the hanger 42 serving as a positive indication that the hanger 42 is positioned at the desired location in the housing 116.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead hanger;

a running tool coupled to the wellhead hanger; and a torque sleeve positioned to transmit torque from the running tool to the wellhead hanger, wherein the running tool is in castellated engagement with the torque sleeve via a first set of castellations and mating slots and the wellhead hanger is in castellated engagement with the torque sleeve via a second set of castellations and mating slots, and wherein the first set of castellations and mating slots include castellations on the running tool and mating slots in an upper end of the torque sleeve.

2. The system of claim 1, wherein the castellations on the running tool include radially protruding castellations received by the mating slots in the upper end of the torque sleeve.

3. The system of claim 1, wherein the second set of castellations and mating slots include castellations on a lower end of the torque sleeve and mating slots in the wellhead hanger.

4. The system of claim 3, wherein the castellations on the lower end of the torque sleeve include axially protruding castellations received by the mating slots in the wellhead hanger.

5. The system of claim 1, wherein the second set of castellations and mating slots are configured to transmit torque from the torque sleeve to the wellhead hanger to drive synchronous rotation of the wellhead hanger and the torque sleeve when the torque sleeve is rotated in a first direction, but to separate the second set of castellations and mating slots to cause the torque sleeve to disengage the wellhead hanger when the torque sleeve is rotated in a second direction opposite the first direction.

6. The system of claim 5, wherein the second set of castellations and mating slots includes a castellation having a stop shoulder positioned to engage an edge of a mating slot to facilitate torque transmission to the wellhead hanger when the torque sleeve is rotated in the first direction, and the castellation or the mating slot includes an angled return surface positioned to cause the mating slot to push the castellation out of the mating slot when the torque sleeve is rotated in the second direction.

7. The system of claim 6, wherein the castellation having the stop shoulder also includes the angled return surface.

8. The system of claim 1, wherein the torque sleeve includes a radial protrusion configured to engage a mating feature of a wellhead housing when the wellhead hanger and the running tool are lowered into the wellhead housing so as to stop downward movement of the torque sleeve while allowing continued downward movement of the wellhead hanger and the running tool.

9. The system of claim 8, wherein the radial protrusion includes a shoulder of the torque sleeve for engaging the mating feature of the wellhead housing.

10. The system of claim 8, comprising the wellhead housing.

11. A system comprising:

a wellhead hanger running tool with an exterior threaded surface for mating engagement with an interior threaded surface of a wellhead hanger; and a sleeve configured to be interposed between castellations of the wellhead hanger running tool and slots in the wellhead hanger, the sleeve including one end with slots for receiving the castellations of the wellhead hanger running tool and another end with castellations to be received by the slots in the wellhead hanger, wherein the sleeve is retained on the wellhead hanger running tool by a retaining ring, coupled to the wellhead hanger running tool, in a manner that allows axial displacement of the sleeve along the wellhead hanger running tool.

12. The system of claim 11, comprising the wellhead hanger, wherein the wellhead hanger running tool is coupled to the wellhead hanger via mating engagement of the interior threaded surface of the wellhead hanger and the exterior threaded surface of the wellhead hanger running tool.

13. The system of claim 12, wherein the wellhead hanger is a casing hanger.

14. The system of claim 11, wherein the slots in the wellhead hanger for receiving the castellations of the sleeve are formed on an exterior surface of the wellhead hanger.

15. A method comprising:

positioning a torque sleeve on a wellhead hanger running tool;

coupling the wellhead hanger running tool to a wellhead hanger while the torque sleeve is positioned on the wellhead hanger running tool;

moving the torque sleeve axially along the wellhead hanger running tool to engage the wellhead hanger to enable rotation of the wellhead hanger running tool to drive rotation of the wellhead hanger via the torque sleeve;

lowering the wellhead hanger into a wellhead via the wellhead hanger running tool;

rotating the wellhead hanger running tool in a first direction to cause, via the torque sleeve, rotation of the wellhead hanger in the first direction; and rotating the wellhead hanger running tool in a second direction opposite the first direction to disconnect the wellhead hanger running tool from the wellhead hanger, wherein rotating the wellhead hanger running tool in the second direction to disconnect the wellhead hanger running tool from the wellhead hanger includes rotating the wellhead hanger running tool such that the torque sleeve contacts the wellhead hanger and the wellhead hanger pushes the torque sleeve out of engagement with the wellhead hanger.

16. A method comprising:

positioning a torque sleeve on a wellhead hanger running tool;

coupling the wellhead hanger running tool to a wellhead hanger while the torque sleeve is positioned on the wellhead hanger running tool;

moving the torque sleeve axially along the wellhead hanger running tool to engage the wellhead hanger to enable rotation of the wellhead hanger running tool to drive rotation of the wellhead hanger via the torque sleeve;

lowering the wellhead hanger into a wellhead via the wellhead hanger running tool; and moving the torque sleeve into engagement with a stop shoulder in the wellhead while the wellhead hanger is lowered into the wellhead, and then continuing to lower the wellhead hanger while the stop shoulder inhibits downward movement of the torque sleeve such that the wellhead hanger disengages from the torque sleeve.

17. A system comprising:

a wellhead hanger;

a running tool coupled to the wellhead hanger; and a torque sleeve positioned to transmit torque from the running tool to the wellhead hanger, wherein: the running tool is in castellated engagement with the torque sleeve via a first set of castellations and mating slots and the wellhead hanger is in castellated engagement with the torque sleeve via a second set of castellations and mating slots; the second set of castellations and mating slots are configured to transmit torque from the torque sleeve to the wellhead hanger to drive synchronous rotation of the wellhead hanger and the torque sleeve when the torque sleeve is rotated in a first direction, but to separate the second set of castellations and mating slots to cause the torque sleeve to disengage the wellhead hanger when the torque sleeve is rotated in a second direction opposite the first direction; the second set of castellations and mating slots includes a castellation having a stop shoulder positioned to engage an edge of a mating slot to facilitate torque transmission to the wellhead hanger when the torque sleeve is rotated in the first direction; and the castellation or the mating slot includes an angled return surface positioned to cause the mating slot to push the castellation out of the mating slot when the torque sleeve is rotated in the second direction.

18. The system of claim 17, wherein the castellation having the stop shoulder also includes the angled return surface.

19. A system comprising:

a wellhead hanger;

a running tool coupled to the wellhead hanger; and a torque sleeve positioned to transmit torque from the running tool to the wellhead hanger, wherein the running tool is in castellated engagement with the torque sleeve via a first set of castellations and mating slots and the wellhead hanger is in castellated engagement with the torque sleeve via a second set of castellations and mating slots, and the torque sleeve includes a radial protrusion configured to engage a mating feature of a wellhead housing when the wellhead hanger and the running tool are lowered into the wellhead housing so as to stop downward movement of the torque sleeve while allowing continued downward movement of the wellhead hanger and the running tool.

20. The system of claim 19, wherein the radial protrusion includes a shoulder of the torque sleeve for engaging the mating feature of the wellhead housing.

21. The system of claim 19, comprising the wellhead housing.

* * * * *